US005694859A

United States Patent [19]

Burke et al.

[11] Patent Number: 5,694,859

[45] Date of Patent: Dec. 9, 1997

[54] HOLE COVERING DEVICE FOR AN AUTO RACK CAR SIDE WALL PANEL

[75] Inventors: Michael K. Burke, Wheaton; Michael K. Murphy, Aurora; Walter J. Peach, Jr., Elgin, all of Ill.

[73] Assignee: Zeftek, Inc., Montgomery, Ill.

[21] Appl. No.: 730,962

[22] Filed: Oct. 16, 1996

[51] Int. Cl.[6] ..... B61D 45/00

[52] U.S. Cl. ..... 105/355; 105/374; 105/404; 52/718.05; 24/662

[58] Field of Search ..... 105/355, 374, 105/378, 392.5, 404, 424; 52/288, 716.1, 716.4, 717.01, 718.05, 718.02; 411/44.5, 49, 57, 508; 403/303, 391; 293/128; 24/453, 662; 410/4, 66; 267/140

[56] References Cited

U.S. PATENT DOCUMENTS 3,709,154 1/1973 Peisner et al. .
4,169,415 10/1979 Winsor .
4,232,612 11/1980 Winsor .
5,239,933 8/1993 Murphy et al. ..... 105/374
5,311,823 5/1994 Rudibaugh et al. ..... 105/355
5,415,108 5/1995 Murphy et al. ..... 105/355
5,490,464 2/1996 Rudibaugh et al. ..... 105/355
5,579,697 12/1996 Burke ..... 105/355

*Primary Examiner*—S. Joseph Morano
*Attorney, Agent, or Firm*—Lloyd L. Zickert

[57] ABSTRACT

A hole covering device attached to the sidewall panels or screens in an auto rack car to prevent the direct passage of air and air-carried contaminants into the auto rack car through the multiplicity of holes in the screens to prevent damage to the finishes of newly manufactured vehicles being transported. The hole covering device includes a non-opaque plastic covering panel which is sized and adapted to be mounted on the interior surface of the screen by a plurality of button fasteners to cover a significant number of the holes in the screen. The covering panel permits light into the car through the covering panel and does not significantly inhibit the ventilation of the vehicle exhaust gases during loading and unloading of the vehicles.

23 Claims, 2 Drawing Sheets

HOLE COVERING DEVICE FOR AN AUTO RACK CAR SIDE WALL PANEL

This invention relates in general to a device for covering holes in the side wall panels or screens of an auto rack railroad car, and more particularly to a hole covering device including a covering panel that is mounted on the screen to cover a significant percentage of holes in the screen to prevent the direct passage of air and air-carried contaminants into the interior of the auto rack car, thereby preventing the vehicles being transported in the car from being damaged by the air-carried contaminants.

BACKGROUND OF THE INVENTION

Heretofore, it has been common practice to transport newly manufactured vehicles, such as automobiles, vans, and trucks, made in this country or imported into this country on auto rack equipped railroad cars. The transportation of newly manufactured vehicles by railroad is usually over long distances above three hundred miles. For example, domestic vehicles manufactured in the Midwest are usually transported to the West Coast by rail, or in another example, imported vehicles manufactured abroad which arrive on the West Coast are usually transported to midwestern cities by rail. A train having auto rack equipped railroad cars, known in the industry as auto rack cars, can take several days to reach its destination while traveling over thousands of miles through varying terrain. These trains travel throughout the year enduring the severest of winter and summer weather as well as other environmental and man-made conditions.

The typical auto rack car is compartmented, having a floor and one or more decks above the floor, opposed side walls, doors in front and back or at each end, and a roof. The side walls are generally constructed of a plurality of horizontally extending and vertically spaced apart side wall panels or screens made of galvanized steel. The vertical rows of screens are mounted between vertical posts that are spaced evenly throughout the length of a car. The screens are usually corrugated and include a multiplicity of round holes or openings that are approximately five-eighths of an inch in diameter for the purpose of providing light and ventilation to the car interiors.

It was previously believed that high velocity air flow outside the car passed over these relatively small sidewall screen holes and that any air-carried contaminants which passed through these holes would drop to the floor or deck due to the lack of high velocity air entering the car though these holes. However, it has subsequently been determined that these holes permit the passage of air and air-carried contaminants directly into the interior of the cars and onto the newly manufactured vehicles being stored in transit. The air-carried contaminants such as iron oxide, smoke or exhaust from the railroad engine, metal filings or shavings from the railroad tracks, dirt or sand carrying chemicals such as fertilizer, acid rain, and other precipitation-containing contaminants, damage the finishes of the vehicles. This damage can be so extensive that the manufacturer or dealer has to repaint or refinish the vehicles.

To solve this problem, the auto industry has sometimes placed protective plastic sheets or wrappings on all or part of the vehicles prior to shipment. Another method of solving this problem has been to manufacture entirely new sidewall screens with significantly fewer holes in the screens. However, fewer holes in the screens prevent an already limited amount of light from entering the cars and can possibly cause a problem with ventilation of the vehicle exhaust gases during loading and unloading. Additionally, the construction and installation of new screens with fewer holes, especially on existing cars, is extremely expensive and time-consuming. Accordingly, there is a need for a relatively inexpensive and easily installed device which prevents the direct passage of air and air-carried contaminants into the interior of the auto rack car, which permits natural light into the car, and which does not significantly inhibit the ventilation of the vehicle exhaust gases during loading and unloading of the vehicles.

SUMMARY OF THE INVENTION

The present invention overcomes the above problems in providing a hole covering device which is mounted on the sidewall panels or screens in an auto rack car to prevent the direct passage of air and air-carried contaminants into the auto rack car through the holes in the screens. The hole covering device of the present invention is easily attached to the interior surface of the screens from the inside of the car, permits light into the car through the holes, and does not significantly inhibit the ventilation of vehicle exhaust gases from the car during the loading and unloading processes.

The hole covering device of the present invention includes a rectangular plastic covering panel or body which is sized and adapted to be mounted on the screen to cover a significant percentage of the holes in the screen. The covering panel has a series of longitudinally spaced apertures or slots positioned along its top and bottom edges and centrally therebetween. The slots are positioned in the covering body for alignment with the sidewall screen holes to facilitate the mounting of the covering panel to the screen by conventional button fasteners. A plurality of button fasteners are inserted through the slots in the covering panel and the sidewall screen holes to lock and maintain the covering panel on the screen. The slots in the covering panel may further be used in attaching a bumper guard to the screen through the covering panel.

The plastic covering panel of the present invention is preferably made from a non-opaque plastic material, such as a low-density translucent polyethylene material. The translucency or transparency of the covering panel permits light to enter into the car through the covering panel, which is particularly important when the car is being loaded and unloaded with vehicles. The non-opaque material is safer because it absorbs less heat and is subject to less expansion and contraction which also facilitates easier alignment and mounting on the sidewall screens.

The hole covering panel may be made in different sizes and shapes depending on the shape of the sidewall screen, may be substantially flat or corrugated, and may also be made in smaller sections for easier handling. While the hole covering panel covers a significant number of the holes in the screen, the covering panel preferably does not cover all of the holes. By not covering all of the holes, the hole covering device does not significantly impair proper ventilation of the car and does not obstruct the attachment of vertical post bumpers, bumper guard devices, or gap closing devices to the side wall panels.

It is therefore an object of the present invention to provide a hole covering device attachable to the side wall panel or screen in an auto rack car which prevents the direct passage of air and air-carried contaminants into the interior of the car to prevent damage to the finishes of newly manufactured vehicles being transported.

Another object of the present invention is to provide a hole covering device attachable to the sidewall panel in an auto rack car which prevents the direct passage of air and air-carried contaminants into the car and which allows light to enter the car through the device.

Another object of the present invention is to provide a hole covering device attachable to the sidewall panel in an auto rack car which prevents the direct passage of air and air-carried contaminants into the car and which does not significantly inhibit ventilation of vehicle exhaust gases from the car.

A still further object of the present invention is to provide a hole covering device which is easily attached to the sidewall panel or screen from the interior of the auto rack car and which prevents the direct passage of air and air-carried contaminants into the car.

A yet further object of the present invention is to provide a hole covering device attachable to the sidewall panel in an auto rack car which prevents the direct passage of air and air-carried contaminants into the car and which facilitates the attachment of a bumper guard to the device and the screen.

Other objects, features and advantages of the invention will be apparent from the following detailed disclosure, taken in conjunction with the accompanying sheets of drawings, wherein like reference numerals refer to like parts.

DESCRIPTION OF THE INVENTION

The hole covering device of the present invention is mounted on the side wall panels or screens in auto rack cars to prevent the direct passage of air and air-carried contaminants into the interior of the auto rack car. The hole covering device generally includes a non-opaque plastic covering panel and a plurality of button fasteners which maintain the covering panel on the screen. The covering panel covers a significant number of the holes in the screens to obstruct the direct entry of air-carried contaminants through those holes which thereby reduces damage to the newly manufacture vehicles being stored in the cars during transport. The covering panel is preferably translucent so that light can be transmitted into the car. Further, the construction is such that it does not significantly inhibit the ventilation of the vehicle exhaust gases during loading and unloading of the vehicles.

Figure 1:
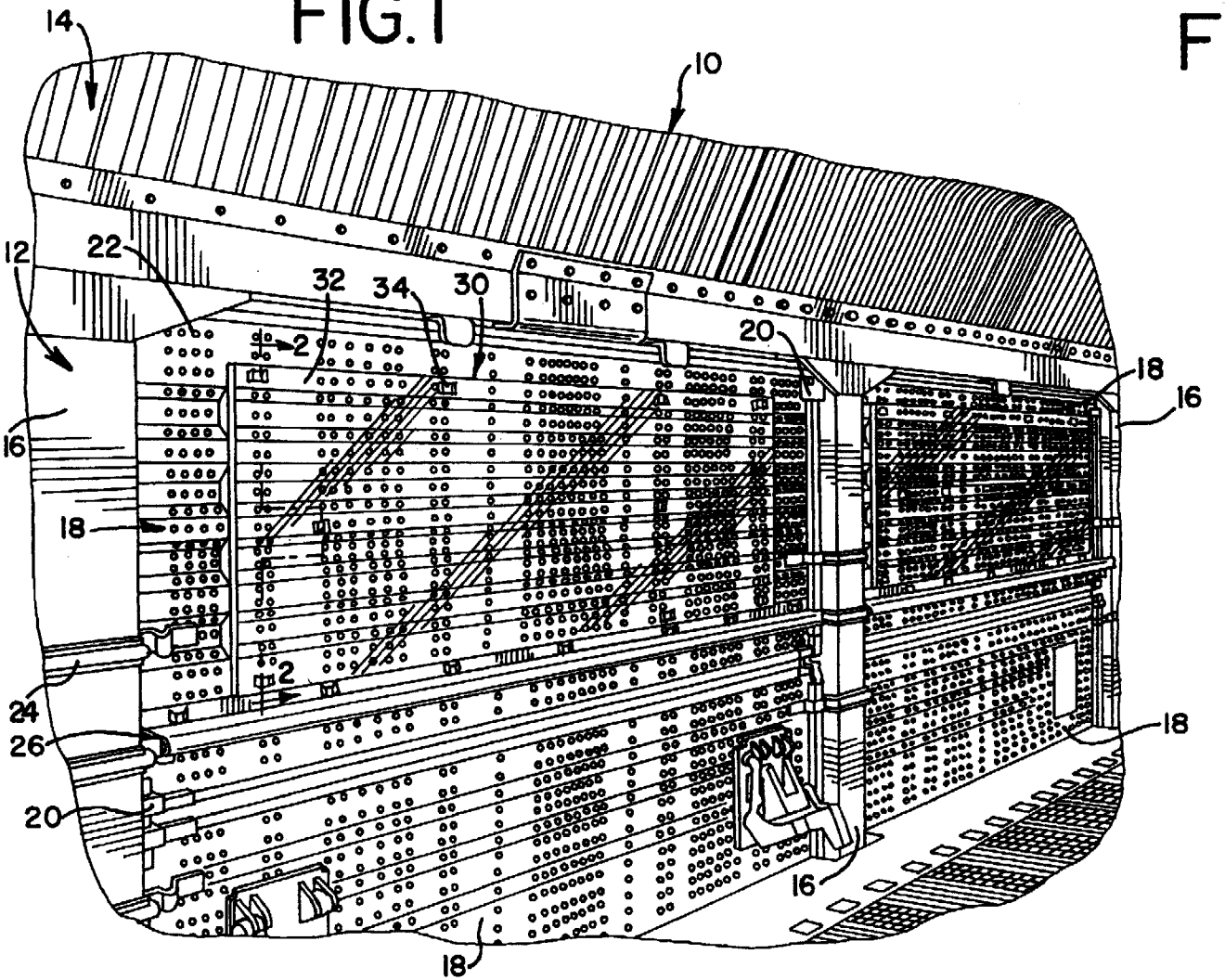
FIG. 1 is a perspective view of the hole covering device of the present invention mounted on the interior face of a sidewall screen in a typical auto rack railroad.

Referring now to the drawings, and particularly to FIG. 1, the inside of a typical auto rack car 10 is illustrated. The auto rack car has multiple levels or decks and includes a frame which supports opposite side walls 12 and a roof 14. The side walls 12 include a series of steel vertical posts 16 which are mounted on and extend upwardly from the frame to the roof 14 which is supported by the vertical posts. The vertical posts 16 are spaced apart along the entire length of both sides walls 12 of the auto rack car. A plurality of rectangular corrugated galvanized steel side wall panels or screens 18 extend horizontally and are vertically spaced apart between each pair of adjacent vertical posts 16. These side wall screens 18 are supported at their corners by metal brackets 20 that are suitably secured to the vertical posts 16. Generally, the screens are approximately one-hundred inches (2.54 m) in length, thirty-six inches (0.9 m) in height, and have a multiplicity of round side wall panel holes 22 that are approximately five-eighths of an inch (16 mm) in diameter. The sidewall panel holes 22 provide ventilation for the auto rack car which is important because toxic vehicle exhaust gases are generated in the car during loading or unloading the vehicles. The holes 22 also permit light to enter into the car which is important for the workers during loading and unloading of vehicles.

Referring now to FIGS. 1 to 4, the hole covering device of the present invention, generally indicated by numeral 30, includes a covering panel 32 sized and adapted to be mounted on the interior surface of the screen 18 to cover a significant number of the holes 22 in the screen and a plurality of button fasteners 34 which are adapted to attach the covering panel on the screen. The covering panel 32 is a substantially flat sheet of about one-sixteenth inch (1.6 mm) thickness non-opaque plastic material, and preferably extruded from off-white low-density translucent polyethylene. A panel having sufficient rigidity and translucency is preferred. For example, the thickness of the covering panel may vary over a range of from one-sixteenth inch (1.6 mm) to one-eighth inch (3.2 mm). The composition of the covering panel material may also vary although a preferable material is linear low-to-medium density polyethylene or a suitable ethylene copolymer which is adapted to withstand temperatures ranging from about minus fifty degrees to about one-hundred-fifty degrees Fahrenheit (–47° to 66° Centigrade). The translucency of the covering panel allows substantially all of the light passing through the panel holes to enter the interior of the car. It is desirable to have a non-opaque panel, such as a translucent or transparent covering panel because the darker or solid colors such as black or gray generally absorb more heat, which would tend to make the cars hotter and block the light. Translucent or transparent material is safer because it remains cooler to the touch by reflecting infrared energy and thereby facilitates better alignment and mounting of the covering panels on the screens since it is subject to less thermal expansion and contraction. It should also be appreciated the panel may be made of other suitable plastics, such as a polycarbonate. Preferably, the panel may also include an ultra-violet inhibitor. It also should be noted that the plastic covering panel and the plastic button fasteners do not create any metal-to-metal contact, which is undesirable in auto rack cars.

The covering panel 32 is rectangular in shape and has top, bottom, and side edges 36, 38, 40, and 42, respectively. These edges and the corners of the covering panel may be rounded or smooth, if desired. The covering panel is approximately eighty-three inches (20.3 m) in length and twenty-five-and-a-half inches (0.65 m) in height for a standard size screen so that a majority of the holes in the screen will be covered. More particularly, it is preferable that the covering panel covers at least sixty-five percent of the holes in the screen. The covering panel 32 is substantially horizontally centered on the screen to leave holes at both ends of the screen uncovered which facilitates attachment of the vertical post bumpers 24 across the vertical posts 16 and to the uncovered holes in the screen 18, as illustrated in FIG. 1. The covering panel 32 is also vertically positioned on the screen to leave holes at the top and bottom of the screen uncovered which facilitates attachment of one or more bumper guard devices 26 on the screen adjacent to the covering panel, as also illustrated in FIG. 1. Similarly, the covering panel does not interfere with the attachment of a gap closing device between vertically adjacent side wall panels, between the sidewall panels and the roof or floor, and between the sidewall panels and the vertical post, as disclosed in U.S. Pat. Nos. 5,239,933 and 5,415,108.

The covering panel 32 includes an upper, central, and lower series of longitudinally spaced slots 44,. 46, 47, and 48 which are positioned, sized, and adapted for alignment with the holes 22 in the screen 18 to receive the button fasteners 34 when the covering panel 32 is mounted on the screen. The slots may be formed in any suitable manual or automated manner, such as by punching, drilling, dye-stamping, or routing. The slots are about one-and-three-quarters inches (4.4 cm) long and five-eighths inch (16 mm) high to facilitate the mounting and aligning with the sidewall panel holes 22 as well as to allow for expansion and contraction of the covering panel 32. Some of the center slots 47 may be elongated up to about two-and-three-quarter inches (7 cm) long to further accommodate the attachment and alignment of a bumper guard 26 directly on the covering panel instead of above or below the covering panel.

Figure 2:
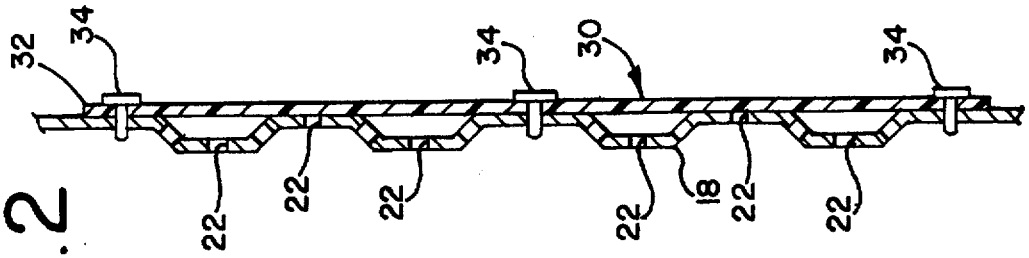
FIG. 2 is a cross-sectional view of the hole covering device and the screen taken substantially along line 2—2 in FIG. 1 and illustrating the attachment of the covering panel to the screen by a plurality of button fasteners.

The manner of mounting the covering panel 32 to the sidewall screen 18 is generally shown in FIGS. 1 and 2. The covering panel 32 is attached to the screen by pushing a suitable button fastener 34 through a slot in the covering panel 32 and through a hole 22 in the screen 18. The button fasteners 34 attach the covering panel to the screen.

Figure 3:
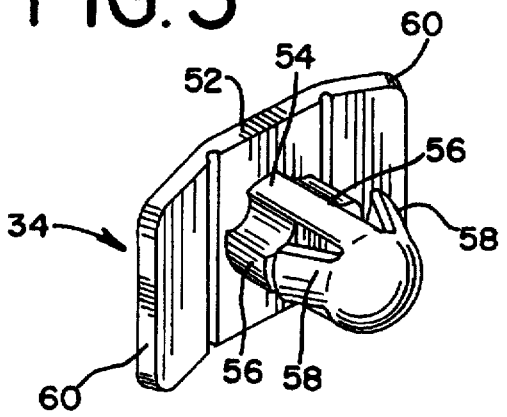
FIG. 3 is a perspective view of the button fastener of the present invention used to mount the covering panel on the screen.

More particularly, as shown in FIG. 3, the button fastener 34 has a rectangular top or head 52 which is sized larger than the height of the slots in the covering panel to maintain a substantial purchase against the interior surface of the covering panel. A shaft or stem 54 is integrally connected to and extends perpendicularly from the button head 52. The shaft 54 has opposing support members 56 integrally connected to the base of the shaft and the bottom of the button head for bracing the shaft. It should be readily appreciated that the circumference of the shaft and the support members is smaller than the height of the slots in the covering panel as well as the holes in the screen. A pair of locking tabs or wings 58 are integrally connected on opposite sides of the shaft 54 at the end of the shaft opposite the head 52. When inserted through the covering panel slot and the screen hole, the locking wings 58 bend or flex toward the shaft 54. After being fully inserted, the locking wings 58 spring back to their original position, as shown in FIGS. 2 and 3, thereby locking the covering panel in place by coacting with the exterior surface of the screen. The button head 52 is formed with a pair of opposing angled flaps 60 which are mounted against their natural angle to constantly exert pressure on the button to bias the locking tabs 58 against the exterior surface of the screen. The button fasteners thereby securely maintain the covering panel on the screen. The button fasteners are preferably black in color and made from a low-density polyethylene that includes an ultraviolet inhibitor which is important because the locking wings and the end of the shaft protrude from the sidewall panel and are subject to ultraviolet rays. It will be appreciated that any suitable button fastener may be used.

While the hole covering panel 32 covers a significant percentage of the holes 22 in the screen 18, the covering panel preferably does not cover all of the holes in the screen. By not covering all of the holes, the hole covering device does not significantly inhibit ventilation of the car. Moreover, since the covering panel is substantially flat and the screen is corrugated, a plurality of spaced apart horizontally extending air passageways are formed between the covering panel and the screen. These passageways are open at the ends and allow some ventilation though the holes while obstructing the passage of rapidly moving air and air-carried contaminants directly into the interior of the car. The flat hole covering device 30 of the present invention does not plug the holes except where the button fasteners are used and thus provides the advantage of maintaining air circulation throughout the car.

To prevent air and air-carried contaminants from entering the car through the horizontally extending air passageways, a suitably sized and shaped vertically extending strip could be suitably attached, such as by button fasteners, to the sidewall screen adjacent to each side of the covering panel. The vertical strip would block the open ends of the horizontally extending air passageways. Likewise, suitably shaped end caps could be attached to the covering panel to close these air passageways.

Figure 5:
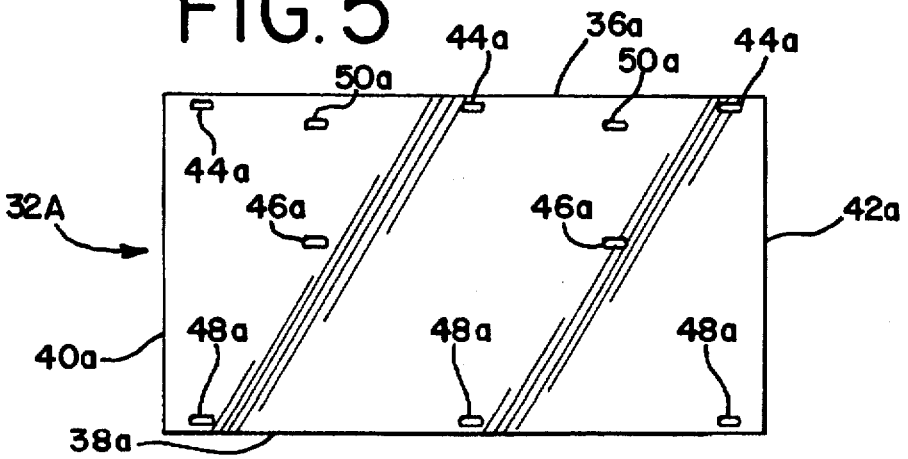
FIG. 5 is a front plan view of an alternatively shaped and sized covering panel of the present invention.

Referring now to FIG. 5, it should be appreciated that the hole covering panel may be made in different sizes and shapes depending on the shape and size of the panel or screen, and may also be made in smaller sections for easier handling. An alternative standard size screen is about sixty-four inches (1.6 m) in length and about thirty-six inches (0.9 m) in height and the alternative covering panel 32A illustrated in FIG. 5 is about forty-seven inches (11.9 cm) in length and about twenty-five and a half inches (0.65 m) in height to cover a significant number of holes in the screen. The covering panel 32A has top, bottom and side edges **36*a*, 38*a*, 40*a*, and 42*a* and includes upper, central, and lower series of longitudinally spaced slots 44*a*, 46*a*, and 48*a* which are sized and adapted for alignment with the holes in the screen to receive the button fasteners when the covering panel is mounted on the screen. The covering panel may include an additional series of longitudinally spaced slots 50*a*** adjacent to its upper edge or elsewhere on the panel for further facilitating alignment with the screen holes.

Figure 6:
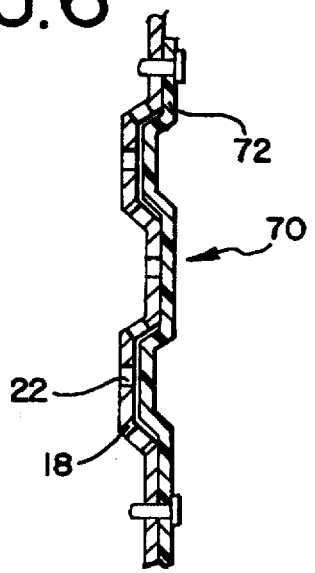
FIG. 6 is a cross-sectional view of a further embodiment of the present invention that includes a corrugated covering panel which is adapted to mate with the corrugated side wall screen.
Figure 4:
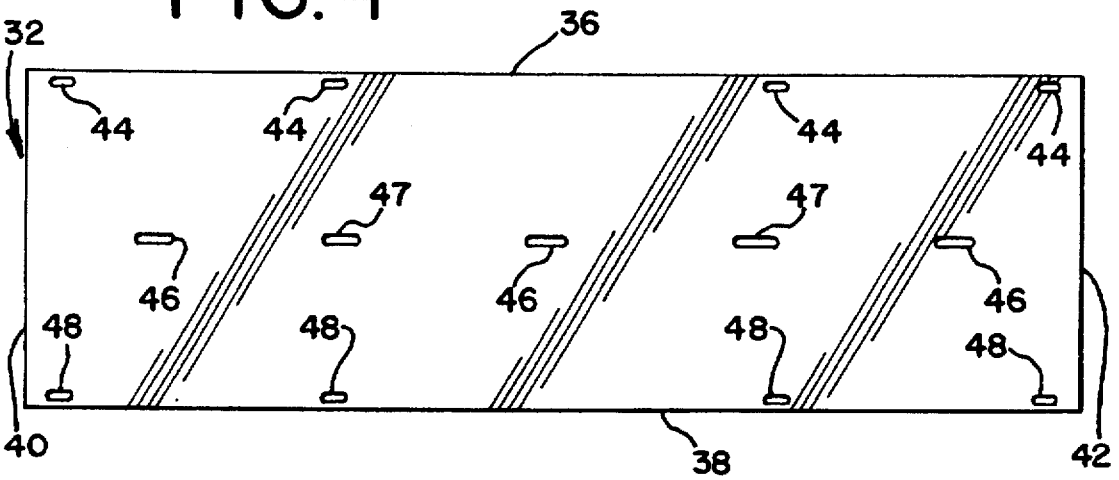
FIG. 4 is a front plan view of the covering panel.

Referring now to FIG. 6, an alternative embodiment of the hole covering device of the present invention, generally indicated by numeral 70, differs from panel 32 in that it includes a corrugated covering panel 72 which is conformed to substantially mate with the corrugated sidewall panel 18. The corrugated covering panel is preformed to match the shape of the sidewall screen 18 and further covers the holes in the screen while eliminating the horizontally extending air passageways. The corrugated covering panel can be tightly installed on the screen to completely block the covered holes in the screen, thereby preventing air and air-carried contaminants from entering the car through those holes. Accordingly, the corrugated covering panels could be formed in smaller sections which cover, but completely block, less holes in the screen, to obtain the same overall result as the flat covering panel. Otherwise, the device 70 operates the same as the panel 32.

It will be understood that modifications and variations may be effected without departing from the scope of the novel concepts of the present invention, and it is understood that this application is to be limited only by the scope of the appended claims.

The invention is hereby claimed as follows:

1. In an auto rack railroad car having opposed side walls including a plurality of screens, said screens having a multiplicity of holes which provide ventilation for the car and allow light into the car, the improvement in a hole covering device comprising:

panel means mounted on said screen for covering a substantial number of said holes in said screen, and fastening means for mounting said panel means on said screen, whereby said panel means prevents the passage of air and air-carried contaminants directly into the interior of the auto rack car through said covered holes to prevent damage to the finishes of newly manufactured vehicles being transported in said car.

2. The hole covering device of claim 1, wherein said panel means covers at least half of the holes in the screen.

3. The hole covering device of claim 1, wherein said panel means allows light into the car.

4. The hole covering device of claim 3, wherein said panel means is translucent.

5. The hole covering device of claim 3, wherein said panel means includes a sheet of non-opaque material.

6. The hole covering device of claim 3, wherein said screens are corrugated and said panel means is corrugated to mate with a respective corrugated screen.

7. The hole covering device of claim 1, wherein said panel means is an elongated flat sheet of extruded low-density translucent polyethylene.

8. The hole covering device of claim 5, wherein said sheet has top and bottom edges and a plurality of slots adjacent those edges for receiving said fastening means.

9. The hole covering device of claim 7, wherein said sheet includes a row of slots between said top and bottom edges to facilitate attachment of a bumper guard to said panel means and said screen.

10. The hole covering device of claim 8, wherein said fastening means includes button fasteners adapted to extend through said sheet and one of said holes in said screen to secure said sheet to said screen.

11. The hole covering device of claim 1, wherein said panel means does not significantly inhibit ventilation of vehicle exhaust gases from the car.

12. In an auto rack railroad car having opposed walls including a plurality of screens, said screens having a multiplicity of holes, the improvement being in means for covering a plurality of said holes in said screen to prevent air and air-carried contaminants from directly entering the interior of the car though said holes without significantly inhibiting ventilation of said car, said means comprising:

panel means attachable to said screen for covering a majority of said holes in said screen, and means for securely attaching said panel means to said screen, whereby said panel means obstructs the passage of air and air-carried contaminants directly into the interior of the auto rack car to prevent damage to the finishes of newly manufactured vehicles being transported in said car.

13. The hole covering means as defined in claim 11, wherein said panel means is non-opaque.

14. The hole covering means as defined in claim 12, wherein said panel means is translucent.

15. The hole covering means as defined in claim 12, wherein said panel means is transparent.

16. The hole covering means as defined in claim 11, wherein said securing means includes a plurality of button fasteners and said panel means includes a sheet of non-opaque plastic having a plurality of preformed slots adapted to receive said button fasteners.

17. In an auto rack railroad car having opposed walls including a plurality of sidewall screens, said screens including a multiplicity of holes, the improvement being in a hole covering device attached to said screens to prevent the passage of air and air-carried contaminants directly into the interior of the auto rack car, said hole covering device comprising:

a covering panel sized when mounted on the screen to cover a plurality of said holes in said screen, said covering panel adapted to allow light into said car through said panel, and button fastening means for mounting said covering panel on said screen, whereby said panel means covers said plurality of holes to block the passage of air and air-carried contaminants directly into the interior of the auto rack car.

18. The hole covering device of claim 17, wherein said covering panel is non-opaque.

19. The hole covering device of claim 18, wherein said covering panel is translucent.

20. The hole covering device of claim 18, wherein said covering panel is transparent.

21. The hole covering device of claim 17, where said covering panel does not significantly inhibit the ventilation of said car.

22. The hole covering device of claim 17, wherein said covering panel is a substantially flat sheet of non-opaque plastic.

23. The hole covering device of claim 17, wherein said covering panel is a corrugated sheet of non-opaque plastic.

* * * * *

UNITED STATES PATENT AND TRADEMARK OFFICE

CERTIFICATE OF CORRECTION

PATENT NO. : 5,694,859

DATED : December 9, 1997

INVENTOR(S) : Michael K. Burke, Michael K. Murphy, and Walter J. Peach, Jr.

It is certified that error appears in the above-indentified patent and that said Letters Patent is hereby corrected as shown below:

Col. 1, line 48, change "though" to --through--;
Col. 3, line 58, change "manufacture" to --manufactured--;
Col. 4, line 5, change "sides" to --side--;
Col. 8, line 7, change "11" to --12--;
line 13, change "11" to --12--; and
line 41, change "where" to --wherein--.

Signed and Sealed this

Tenth Day of March, 1998

Bruce Lehman

*Attest:*

BRUCE LEHMAN

*Attesting Officer*

*Commissioner of Patents and Trademarks*